US005813421A

United States Patent [19]

Wang

[11] Patent Number: 5,813,421

[45] Date of Patent: Sep. 29, 1998

[54] LIPSTICK SWIVEL MECHANISM

[75] Inventor: Chun Te Wang, Hsin-Chu, Taiwan

[73] Assignee: Der Kwei Cosmetic Packaging Co., Limited, Hsin Chu, Taiwan

[21] Appl. No.: 891,619

[22] Filed: Jul. 9, 1997

[51] Int. Cl.[6] ..... A45D 40/06

[52] U.S. Cl. ..... 132/318; 401/68

[58] Field of Search ..... 132/318, 320; 401/68, 69, 71, 87, 82

[56] References Cited

U.S. PATENT DOCUMENTS

| | | | |
|---|---|---|---|
| 3,230,960 | 1/1966 | Moore et al. | 132/318 |
| 4,323,157 | 4/1982 | Idec | 132/318 |
| 4,966,479 | 10/1990 | Idec et al. | 132/320 |

FOREIGN PATENT DOCUMENTS

| | | | |
|---|---|---|---|
| 1205370 | 2/1960 | France | 401/68 |

*Primary Examiner*—Todd E. Manahan
*Attorney, Agent, or Firm*—Bacon & Thomas

[57] ABSTRACT

A lipstick swivel mechanism includes a cup having a cup body for holding a lipstick bullet; a nosepiece for containing the cup and guiding the movement of the cup; a spiral rotatably connected to the nosepiece, having helical guiding grooves formed on the inner surface thereof; and a screw received within the spiral and detachably connected to the cup. The screw has double helical protrusions, formed on the outer surface of the screw. The double helical protrusions are received in and guided by the helical guiding grooves inside the spiral so as to make the screw and the cup move upward or downward when the spiral is rotated. The problem of idling rotation of screw may be solved.

2 Claims, 6 Drawing Sheets

LIPSTICK SWIVEL MECHANISM

BACKGROUND OF THE INVENTION

1. Field of the Invention

This invention relates to a lipstick swivel mechanism including a screw having a double-helix structure so as to avoid idling rotation of the screw.

2. Description of the Related Prior Art

It is known that a lipstick is typically designed to be able to protrude out from or to withdraw back into its housing by rotating operation. FIG. 1 shows the assembled sectional view of a prior lipstick swivel mechanism, FIG. 2A shows the exploded perspective view of same lipstick swivel mechanism, and FIGS. 2B through 2D shows the details of the comprising members in same lipstick swivel mechanism. The prior lipstick swivel mechanism includes: an upper lid 11; a spiral-base member 15 provided with internal helical guiding grooves 15*a* (FIG. 2D) therein; a screw-cup member 12 including a cup portion 12*a* for holding a bullet, and a screw portion 12*b*, integrally formed with the cup portion 12*a*, which has two guiding posts 12*c* and 12*d* (FIG. 2A) at its lower portion, and which is forced to move upward or downward along the helical guiding grooves 15*a* of the spiral-base member 15 for protruding or withdrawing the bullet held by the cup portion 12*a* when the spiral-base member 15 is turned; a nosepiece member 13 having two vertical slots 13*b* and 13*c* (FIGS. 2A, 2B, and 2C) into which are inserted the guiding posts 12*c* and 12*d* for guiding the vertical movement of the screw-cup member 12; a wedding band 14 which is adapted to rotatably support the nosepiece member 13, and which has, on its outer surface, protrusions 14*a* and 14*b* (FIG. 2A) respectively for engagement with corresponding recesses (FIG. 1) formed on the internal surfaces of the upper lid 11 and the spiral-base member 15 so that the wedding band 14 may be assembled within the upper lid 11 and the spiral-base member 15.

Two slots 12*e* ( only one slot is shown in FIG. 2A) are formed at the lower portion of the screw-cup member 12 between the posts 12*c* and 12*d*. The function of the two slots is described below. When assembling the screw-cup member 12 into the nosepiece member 13 from the above (see FIGS. 1 and 2A), since the outer diameter of the screw-cup member 12 at the location of the two posts 12*c* and 12*d* is larger than the inner diameter of the nosepiece member 13, an inward pressure must be applied onto the two posts 12*c* and 12*d* to deform the screw-cup member 12 slightly at the slots 12*e* so that it may move downwardly through the central hole of the nosepiece member 13. The above deformation of screw-cup member 12 would be impossible or very difficult but for the slots 12*e*. After the two posts 12*c* and 12*d* reach the top of vertical slots 13*b* and 13*c* at the lower part of the nosepiece member 13, the compressed screw-cup member 12 recovers its original shape and the two posts 12*c* and 12*d* extend outwards through the vertical slots 13*b* and 13*c*, respectively, with their outer ends being engaged into the helical guiding grooves 15*a* formed on the inner surface of the spiral-base member 15 (see FIG. 1).

One of the disadvantages of the prior lipstick swivel mechanism is that the existence of the vertical slots 12*e* reduces the rigidity of the lower part of screw-cup member 12. When the posts 12*c* and 12*d* rise up to the top of the vertical slots 13*b* and 13*c* and further upward movement of the screw-cup member 12 is stopped. Under this situation, if an turning force exceeding a predetermined design value is applied upon the spiral-base member 15, the lower part of screw-cup member 12 will be deformed so as to make the posts 12*c* and 12*d* withdraw inwardly away from the helical guiding grooves 15*a*, idling rotation of the screw-cup member 12 may thus occur. If the user keeps on turning the spiral-base member 15, idling rotation of the screw-cup member 12 will repeat while the lipstick stays in the top place.

Therefore, the primary object of the invention is to provide an improved lipstick swivel mechanism by which idling rotation of the screw may be avoided.

SUMMARY OF THE INVENTION

The lipstick swivel mechanism according to the invention includes:

a cup having a cup body for holding a lipstick bullet;

a nosepiece for containing the cup and guiding the cup to move upward or downward;

a spiral rotatably connected to the nosepiece, having helical guiding grooves formed on the inner surface thereof;

a screw received within the spiral and detachably connected to the cup;

a base for containing the spiral;

characterized in:

that the cup has at least two separate elastic barbs integrally formed at the bottom surface of the cup body and capable of slight radial deflection, and a first bevelled engaging portion constituted by a plurality of bevelled ribs disposed around the connecting area of the barbs with the bottom surface of the cup body; and that the screw has: a second bevelled engaging portion, constituted by a plurality of bevelled grooves, disposed around the top of the screw, for guiding the insertion of the barbs of the cup into the screw upon assembling and for engaging with the first bevelled engaging portion to prevent relative rotation between the cup and the screw; a stepped portion for stopping the barbs of the cup, which is inserted into the screw, to avoid detaching of the cup from the screw; double helical protrusions, formed on the outer surface of the screw, received in and guided by the helical guiding grooves inside the spiral so as to make the screw and the cup move upward or downward when the spiral is rotated.

Preferably, the screw has a constant cross-sectional profile other than a circular shape, and the nosepiece includes an opening, at a portion adapted to allow the screw to pass therethrough, whose shape is complementary to the constant cross-sectional profile of the screw for confining the rotation of the screw relative to the nosepiece during vertical movement.

The invention is further illustrated by description of the preferred embodiment with the corresponding figures hereinafter.

DESCRIPTION OF THE PREFERRED EMBODIMENT(S)

Figure 1:
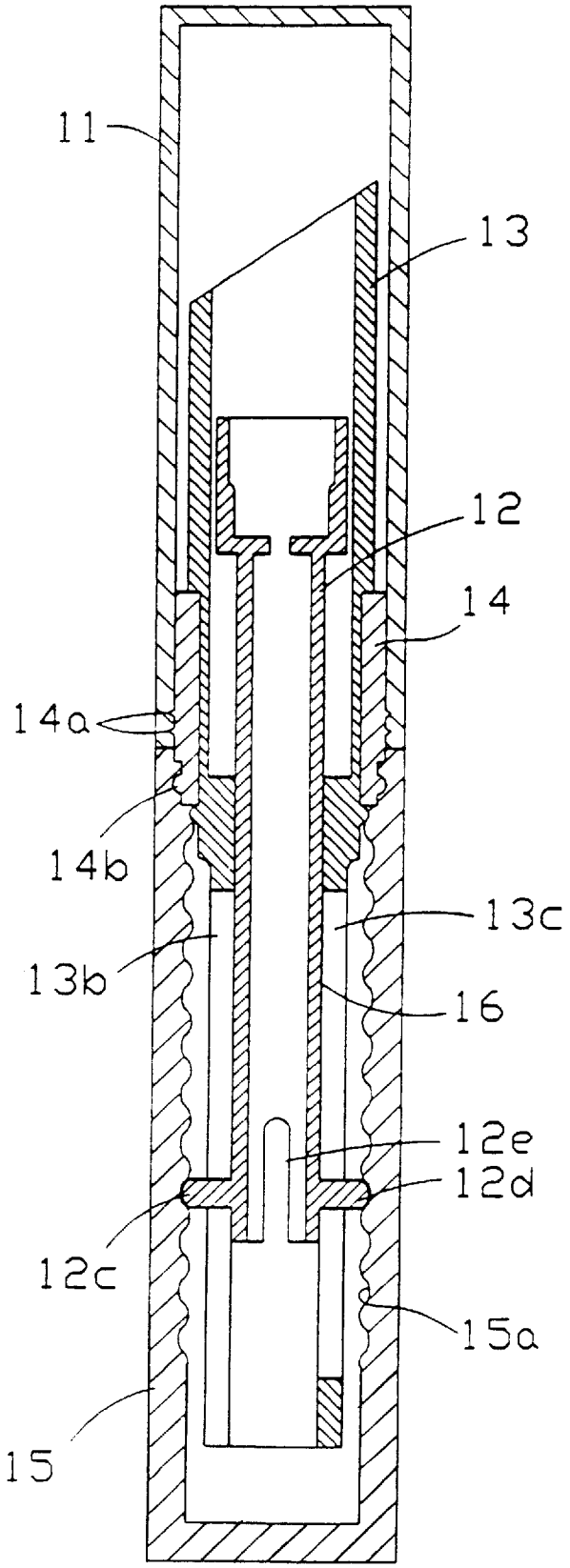
FIG. 1 (PRIOR ART)
FIG. 1 shows the longitudinal sectional view of a prior lipstick swivel mechanism.
Figures 2A, 2B, 2C, 2D:
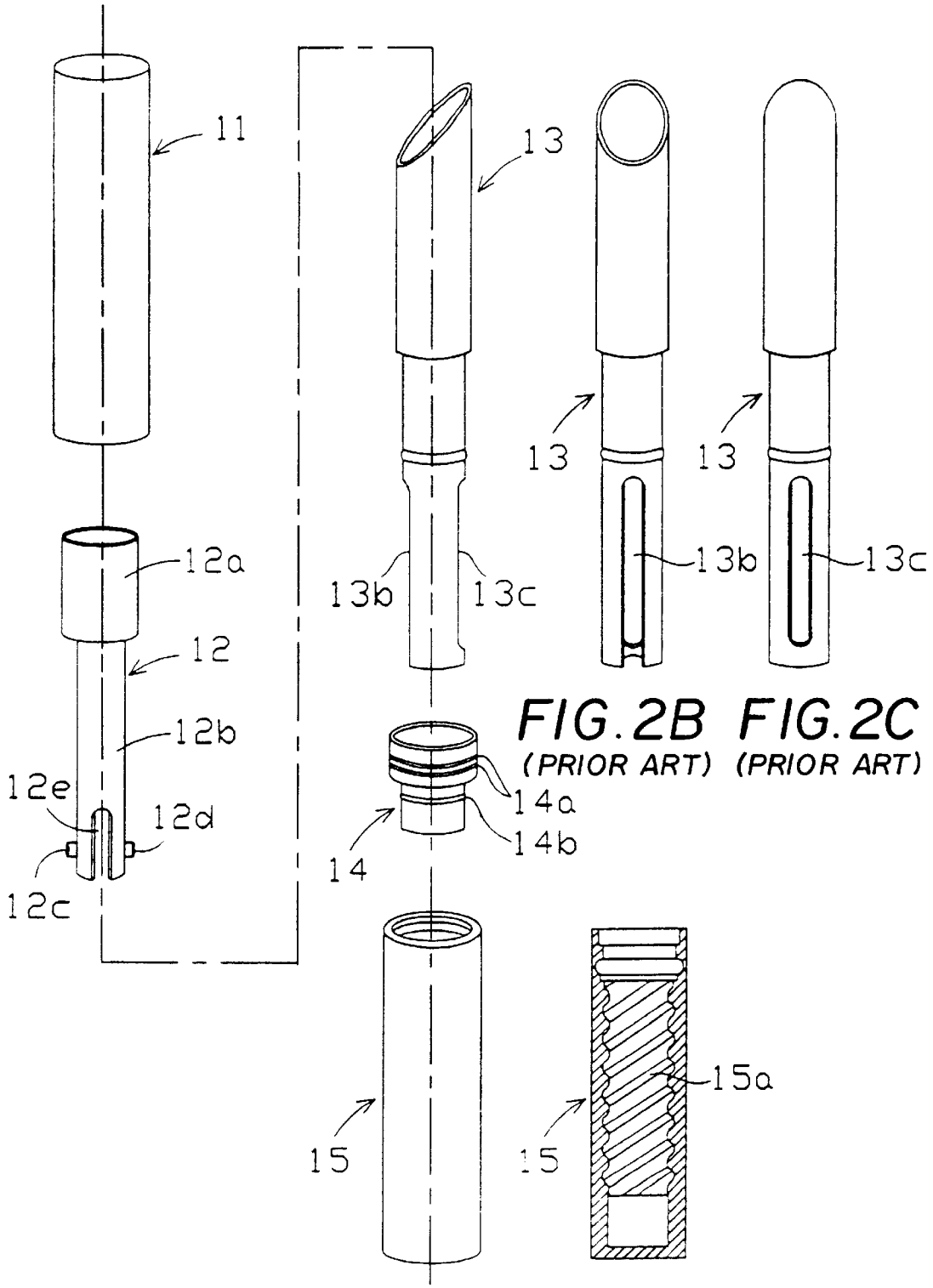
FIG. 2B (PRIOR ART) FIG. 2C (PRIOR ART)
FIG. 2A (PRIOR ART) FIG. 2D (PRIOR ART)
FIG. 2A is the exploded perspective view of same prior lipstick swivel mechanism.
FIG. 2B is the perspective view of a nosepiece member in same prior lipstick swivel mechanism.
FIG. 2C is the perspective view of same nosepiece member.
FIG. 2D is the perspective view of a spiral-base member in same prior lipstick swivel mechanism.
Figure 3A:
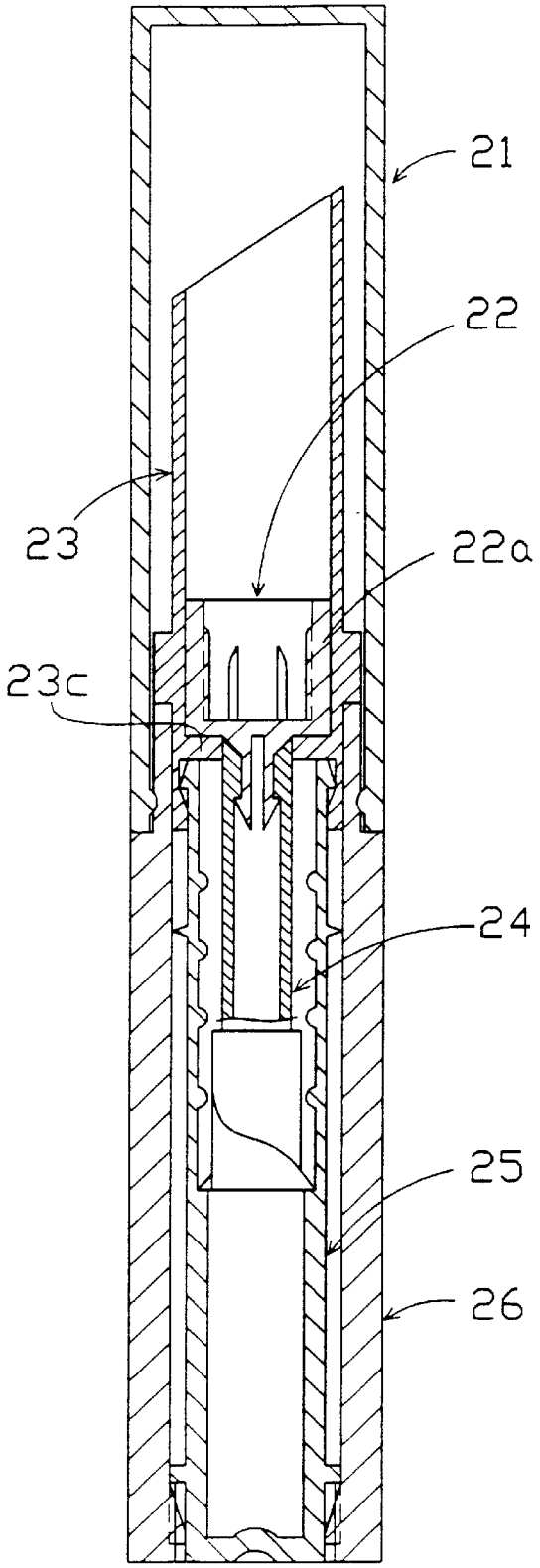
FIG. 3A shows the longitudinal sectional view of a lipstick swivel mechanism according to this invention.
Figure 4A:
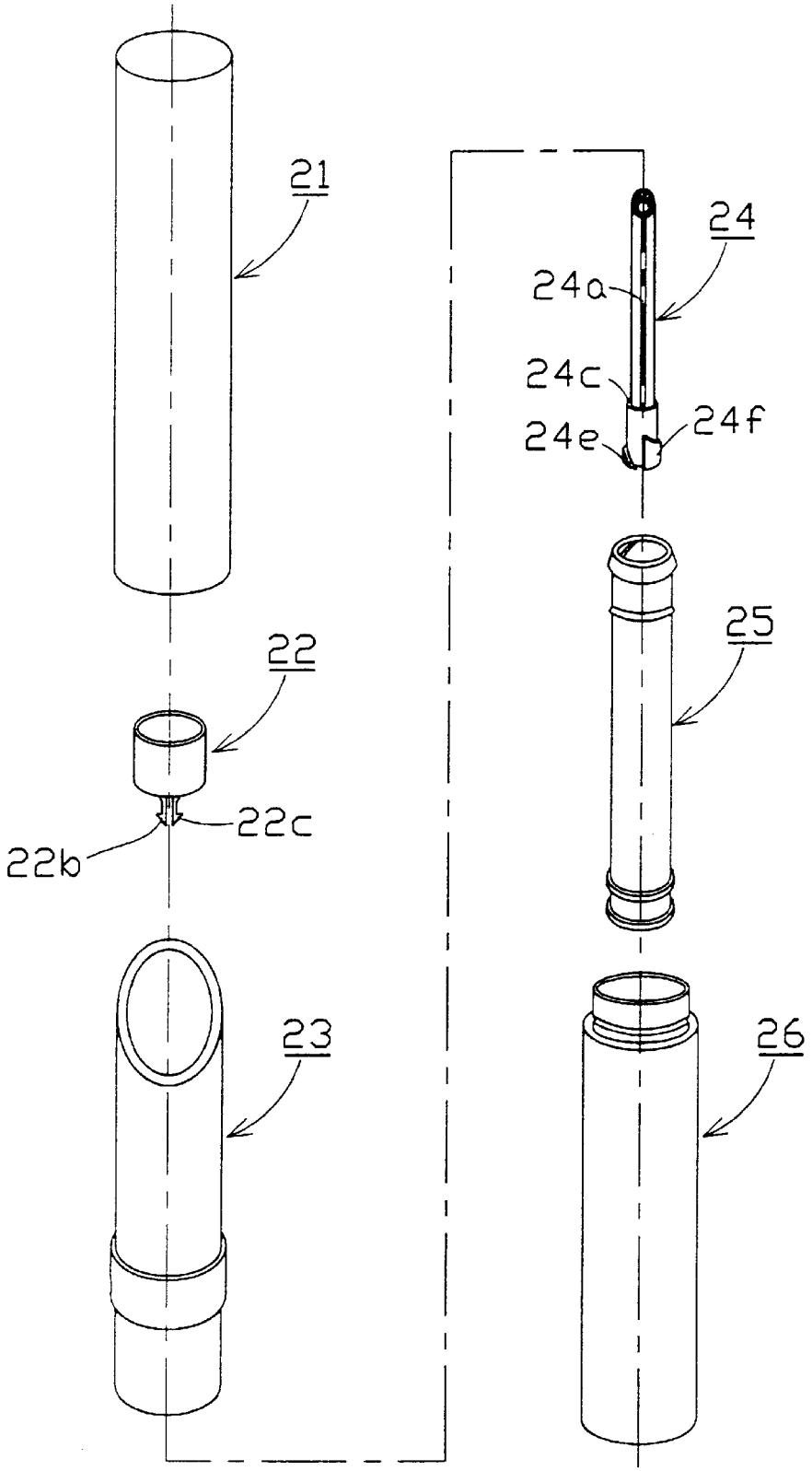
FIG. 4A is the exploded perspective view of same lipstick swivel mechanism according to this invention.

As best shown in FIGS. 3A and 4A, a lipstick swivel mechanism according to this invention includes an upper lid 21, a cup 22, a nosepiece 23, a screw 24, a spiral 25, and a base 26. The base 26 is adapted to contain the spiral 25.

Figure 3B:
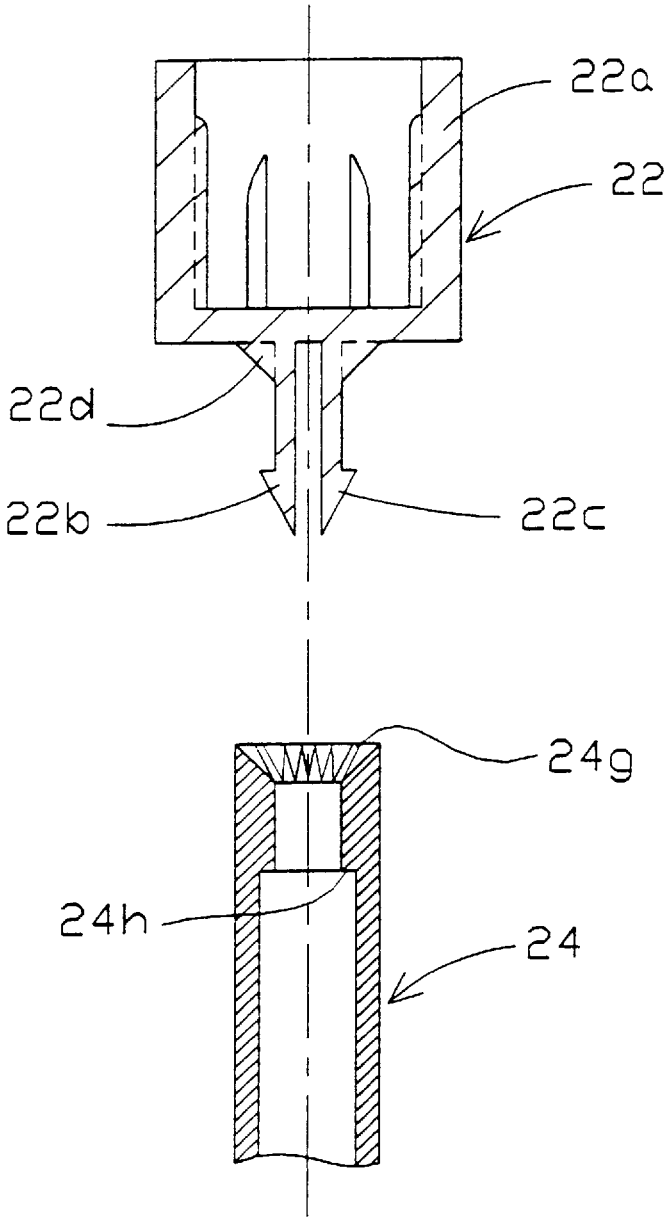
FIG. 3B the exploded sectional view of two members in same lipstick swivel mechanism according to this invention.

The cup 22 has a cup body 22*a* for holding a lipstick bullet(not shown) therein. At least two separate elastic barbs 22*b*, 22*c* capable of slight radial deflection are integrally formed at the bottom surface of the cup body 22*a*. Also, as shown in FIG. 3B, a first bevelled engaging portion constituted by a plurality of bevelled ribs 22*d* are disposed around the connecting area of the barbs 22*b*, 22*c* with the bottom surface of the cup body 22*a*.

Figure 4D:
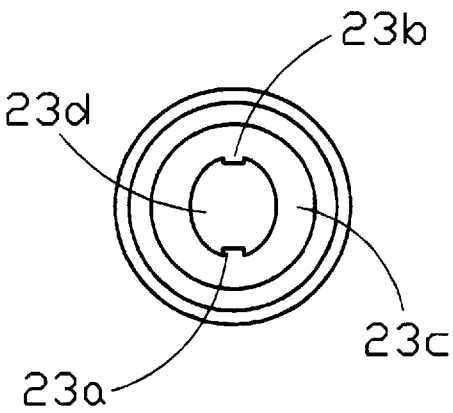
FIG. 4D is the top view of a nosepiece in same lipstick swivel mechanism according to this invention.

The nosepiece 23 is adapted to receive therein the cup 22 and also to guide the cup 22 to move upward or downward. Referring to FIG. 3A, the nosepiece 23 is substantially hollow with its interior being generally divided, by a partitioning wall 23*c*, into an upper part for receiving the cup body 22*a* of the cup 22 and a lower part. As shown in FIG. 4D, the partitioning wall 23*c* includes a central hole 23*d* adapted to allow the screw 24 to pass therethrough, and two protrusions 23*a* and 23*b* of which the function is to be described latter.

Figure 4C:
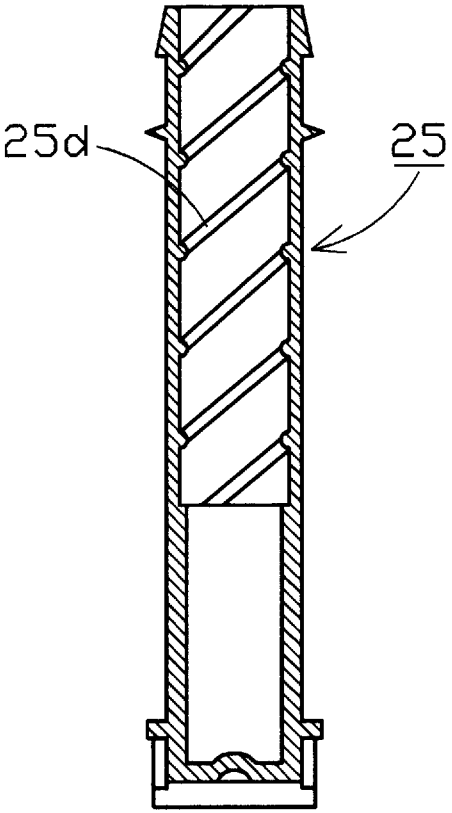
FIG. 4C is the longitudinal sectional view of a spiral in same lipstick swivel mechanism according to this invention.

The spiral 25 is rotatably connected to the nosepiece 23, and has two helical guiding grooves 25*d* formed on the inner surface thereof (FIG. 4C).

Figure 4B:
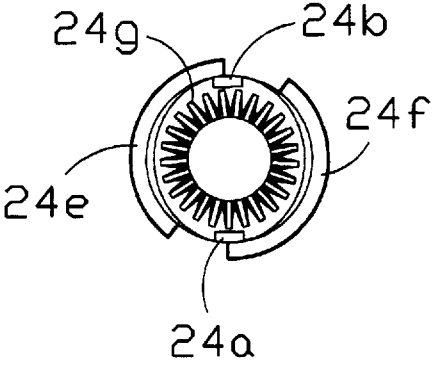
FIG. 4B is the top view of a screw in same lipstick swivel mechanism according to this invention.

The screw 24 is received within the spiral 25, and detachably connected to the cup 22. In specific, the screw 24 has: a second bevelled engaging portion, constituted by a plurality of bevelled grooves 24*g* (see FIGS. 3B and 4B), disposed around the top of the screw 24, for guiding the insertion of the barbs 22*b*, 22*c* of the cup 22 into the interior of the screw 24 upon assembling and for engaging with the bevelled ribs 22*d* to prevent relative rotation between the cup 22 and the screw 24; a stepped portion 24*h* for stopping the barbs 22*b*, 22*c* of the cup 22, which is inserted into the screw 24, to avoid unintentional detaching of the cup 22 from the screw 24; two helical protrusions 24*e*, 24*f*, formed on the outer surface of the screw, received in and guided by the helical guiding grooves 25*d* inside the spiral 25 so as to make the screw 24 move upward or downward together with the cup 22 when the spiral 25 is turned. For restricting the upper limit of the upward movement of the screw 24, a stepped portion 24*c* is formed on the outer surface of the screw 24 so as to stop its upward movement when the stepped portion 24*c* is stopped by the partitioning wall 23*c*, of the nosepiece 23. As shown in FIGS. 4A and 4B, the screw 24 has, at its upper portion, a constant cross-sectional profile other than a circular shape. Namely, on the outer surface of the upper part of the screw 24 are provided with two recesses 24*a*, 24*b*, respectively, corresponding to the two protrusions 23*a* and 23*b* formed on the partitioning wall 23*c* of the nosepiece 23 for confining the rotation of the screw 24, during its vertical movement, relative to the nosepiece 23.

The primary advantage of the lipstick swivel mechanism according to this invention resides in that a double helical protrusion structure, which is hard to deform, is adopted to replace the prior guiding post structure. When the double helical protrusions rise up to the top of the spiral, the protrusions will steadily remain within the guiding grooves even if the user keeps on turning the base. Consequently, the problem of idling rotation of screw may be solved.

The aforesaid preferred embodiment is used only for illustrating rather than limiting the invention. Variations and modifications can be made without departing from the spirit of the present invention. Therefore, the scope of the present invention is intended to cover the following appended claims.

It is claimed:

1. A lipstick swivel mechanism comprising:

a cup having a cup body for holding a lipstick bullet;

a nosepiece for containing said cup and guiding said cup to move upward or downward;

a spiral rotatably connected to said nosepiece, having helical guiding grooves formed on the inner surface thereof;

a screw received within said spiral and detachably connected to said cup;

a base for containing said spiral;

characterized in:

that said cup has at least two separate elastic barbs integrally formed at the bottom surface of said cup body and capable of slight radial deflection, and a first bevelled engaging portion constituted by a plurality of bevelled ribs disposed around the connecting area of said barbs with the bottom surface of said cup body; and that said screw has: a second bevelled engaging portion, constituted by a plurality of bevelled grooves, disposed around the top of said screw, for guiding the insertion of said barbs of said cup into said screw upon assembling and for engaging with said first bevelled engaging portion to prevent relative rotation between said cup and said screw; a stepped portion for stopping said barbs of said cup, which is inserted into said screw, to avoid unintentional detaching of said cup from said screw; double helical protrusions, formed on the outer surface of said screw, received in and guided by said helical guiding grooves inside said spiral so as to make said screw and said cup move upward or downward when said spiral is rotated.

2. A lipstick swivel mechanism as described in claim 1, further characterized in that said screw has, at partial portion thereof, a constant cross-sectional profile other than a circular shape, and said nosepiece includes an opening, at a portion adapted to allow said screw to pass therethrough, whose shape is complementary to said constant cross-sectional profile of said screw for confining the rotation of said screw relative to said nosepiece during vertical movement.

* * * * *